US006375112B1

(12) United States Patent
Engelhardt

(10) Patent No.: US 6,375,112 B1
(45) Date of Patent: Apr. 23, 2002

(54) DEVICE FOR WINDING CONICAL BOBBINS AT A CONSTANT YARN DELIVERY RATE

(75) Inventor: Dietmar Engelhardt, Mönchengladbach (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/542,765

(22) Filed: Apr. 5, 2000

(30) Foreign Application Priority Data

Apr. 7, 1999 (DE) ..... 199 15 529

(51) Int. Cl.[7] ..... B65H 77/00; B65H 59/00

(52) U.S. Cl. ..... 242/419.2; 242/417; 242/485.1; 242/485.7

(58) Field of Search ..... 242/416, 417, 242/419.2, 419.7, 147 M, 154, 485.1, 485.7

(56) References Cited

U.S. PATENT DOCUMENTS

| | | | | |
|---|---|---|---|---|
| 4,113,193 A | * | 9/1978 | Raasch et al. | 242/18 R |
| 4,928,904 A | * | 5/1990 | Watts | 242/158 R |
| 4,988,048 A | * | 1/1991 | Lochbronner | 242/18 R |
| 5,092,534 A | * | 3/1992 | Tanaka | 242/155 M |
| 5,146,651 A | * | 9/1992 | Duffy et al. | 19/65 T |
| 5,823,460 A | * | 10/1998 | Hermanns | 242/485.7 |
| 6,039,282 A | * | 3/2000 | Hermanns et al. | 242/485.1 |
| 6,095,449 A | * | 8/2000 | Gallo et al. | 242/365.4 |

FOREIGN PATENT DOCUMENTS

| | | |
|---|---|---|
| DE | 1 814 928 | 3/1970 |
| DE | 24 54 917 C2 | 8/1976 |
| DE | 26 10 084 A1 | 9/1977 |
| EP | 0 284 144 A1 | 9/1988 |
| EP | 0284 146 A1 | 9/1988 |
| EP | 0 284 147 A1 | 9/1988 |
| EP | 0 284 149 A1 | 9/1988 |

* cited by examiner

*Primary Examiner*—Donald P. Walsh
*Assistant Examiner*—Joseph Rodriguez
(74) *Attorney, Agent, or Firm*—Kennedy Covington Lobdell & Hickman, LLP

(57) ABSTRACT

A device for winding conical cross-wound bobbins has a creel pivotably mounted about a pivot axis and receiving the conical bobbin, a yarn guide traversing alongside the creel, and a yarn accumulator adapted to accumulate and pay-out a stored length of yarn. The prevailing instantaneous driven diameter ($d_a$) of the cross-wound bobbin (24) is detected by a first sensor device (48, 48'), the prevailing instantaneous position and/or the direction of travel of the yarn guide (36) is detected by a second sensor device (50, 50'), and the sensor devices (48, 48', 50, 50') are connected to a control device (46) which supplies a control signal for a drive (40) of the yarn accumulator (32) as a function of the signals supplied.

12 Claims, 3 Drawing Sheets

DEVICE FOR WINDING CONICAL BOBBINS AT A CONSTANT YARN DELIVERY RATE

CROSS-REFERENCES TO RELATED APPLICATIONS

This application claims the benefit of German patent application DE19915529.1, filed Apr. 7, 1999, herein incorporated by reference.

BACKGROUND OF THE INVENTION

The present invention relates to a device for winding conical cross-wound bobbins at a constant yarn delivery rate.

It is known in conjunction with open-end spinning machines that their winding devices can be provided with a controlled yarn accumulator for temporary storage of the yarn being wound during the winding of conical cross-wound bobbins. Such yarn accumulators serve the purpose of adapting the different yarn winding rates occurring in the area of the winding device during the winding of conical cross-wound bobbins to the constant yarn delivery rate of the spinning device. In the known devices, the cross-wound bobbin is held during the winding process in a pivotably mounted creel and is customarily driven by a friction roller via frictional surface contact. The winding rate of the cross-wound bobbin in the area of its driven diameter corresponds thereby to the constant yarn delivery rate of the spinning device. Thus, as a result of the conical shape of the bobbin, when the yarn is wound on the smaller diameter end of the cross-wound bobbin, the instantaneous yarn winding rate is below the set value of the yarn delivery rate and, likewise, when the yarn is wound on the larger diameter end of the cross-wound bobbin, the instantaneous yam winding rate is above the set value of the yarn delivery rate. Thus, to compensate, the excess yarn length delivered from the spinning device during the intervals when the yarn is being wound on the smaller end of the bobbin is temporarily stored at an intermediate location in a yarn accumulator. This intermediately stored yam length is given off by the yarn accumulator when the yam winding rate of the winding device in the direction of the larger diameter end of the cross-wound bobbin rises above the yam delivery rate of the spinning device.

Additionally, the ratio between the small bobbin diameter and the large bobbin diameter determines the yarn length to be fed by the controlled yarn accumulator per yarn guide stroke. Since the ratio of the small bobbin diameter to the large bobbin diameter changes with the continuing increase of the bobbin diameter as the winding operation progresses, the yarn length which the yarn accumulator receives and gives off must also be constantly adapted. In order to achieve this purpose, it is known to associate a control device with the yarn accumulator to appropriately adapt the accumulated yarn reserve of the yarn accumulator to the progress of the winding process.

Known yarn accumulators comprise a pivot lever which can be pivoted toward and away from the yarn travel path, therewith temporarily lengthening and shortening the overall length of the regular yarn travel path. Customarily, this pivot lever is moveably mounted about an axis of rotation and can be positioned by a drive.

European Patent Document EP 0,284,149 teaches a controllable yarn accumulator whose position determining the accumulated amount of yarn can be varied by an electrical drive. A control of the electrical drive takes place via a control device receiving its initial information from a yarn tension sensor. That is, when the yarn tension changes during the winding of the cross-wound bobbin, e.g., as a function of changes in the instantaneous yarn winding rate, the control device reacts with a corresponding control of the yarn accumulator.

Furthermore, German Patent Publication DE 18 14 928 A1 teaches a bobbin cross-winding device for producing conical bobbins in which the yarn guide and an additional means which scans the circumference of the cross-wound bobbin are mechanically coupled via a cam disk and a lever linkage to the yarn accumulator.

Finally, German Patent Publication DE 24 54 917 C2 teaches a method and a device for winding conical cross-wound bobbins in which the yarn accumulator is continuously controlled in proportion to the bobbin circumference of the cross-wound bobbin. In order to determine the instantaneous bobbin circumference of the cross-wound bobbin, the pivotably mounted creel is provided with a measuring element which detects the pivot position of the creel and controls the position of the yarn accumulator via a mechanical coupling element.

The known devices for winding conical cross-wound bobbins have the disadvantage that the control of the yarn accumulator is deficient either on account of the plurality of mechanical coupling elements or that, as in the case of European Patent Document EP 0,284,149, the yarn accumulator length determined by the yarn tension measurement is relatively imprecise.

SUMMARY OF THE INVENTION

It is accordingly an object of the present invention to overcome the above-described problems of the known controls for accumulators in conical bobbin winding devices and, more particularly, it is an object of the invention to provide an improved device for more precisely controlling the yarn accumulator in a simple manner.

Briefly summarized, the present invention addresses this objective by a device which makes possible an exact control of the yarn accumulator at all times by detecting the instantaneously driven diameter of the cross-wound bobbin by a first sensor device, detecting the instantaneous position and/or the direction of movement of the yarn guide by a second sensor device, and connecting the two sensor devices to a control device. The control device controls of the yarn accumulator by taking into consideration not only the actual yarn winding rate of the winding device but also the ratio at the same point in time between the large and the small diameter of the cross-wound bobbin. In this manner, the precisely required amount of yarn is constantly stored in an intermediate fashion so that, during the winding of the cross-wound bobbin, undesired changes in yarn tension can be avoided to a very great extent.

In this manner, the instantaneous winding state of the cross-wound bobbin can be directly detected by using the sensor devices of the invention. Both the position of the yarn guide, which reflects the instantaneous point at which the yarn is applied to the cross-wound bobbin, and the instantaneous diameter of the cross-wound bobbin provide in real time the essential information as to the operating condition of the winding device necessary to determine the precise yarn length to be fed to the bobbin. Accumulator errors can be reduced to a negligible minimum by such an arrangement. In addition, a plurality of mechanical coupling elements are eliminated, which results in a fundamentally simplified accumulator device which also requires, in particular, less space.

Precise reference can be made to the instantaneous diameter of the cross-wound bobbin at the point at which the yarn is being applied to the bobbin by means of algorithms, stored in the control device, for defining the control signal for the drive of the yarn accumulator. This results in a very exact control of the yam accumulator.

A known device operating with a Hall sensor mechanism device can be provided to detect the particular pivot angle of the bobbin creel and thereby can advantageously serve as the sensor device for determining the instantaneous diameter of the cross-wound bobbin. A mathematical determination is an alternative possibility for determining the instantaneous, driven diameter of the cross-wound bobbin. Such a mathematical calculation may be performed by detecting the speed of the cross-wound bobbin by a sensor arranged on the bobbin creel and using the detected bobbin speed in conjunction with the known speed and diameter of the friction drive roller for determining the driven diameter of the cross-wound bobbin.

In a preferred embodiment of the invention, the drive of the yarn accumulator is designed as a stepping motor. The stepping motor can be very precisely controlled via the control device so that the winding conditions which are continuously changing during the winding process (i.e., the precise point at which the yarn is applied to the bobbin, which constantly changes as a result of the traversing motion of the yam guide, and the diameter of the cross-wound bobbin, which constantly changes as the winding operation progresses) can be reacted to and the amount of yarn to be stored, which is dependent thereupon, can be adjusted to directly compensate in a simple manner.

The invention will be explained in greater detail in the following disclosure of exemplary embodiments with reference to the associated drawings.

DESCRIPTION OF THE PREFERRED EMBODIMENTS

Figure 1:
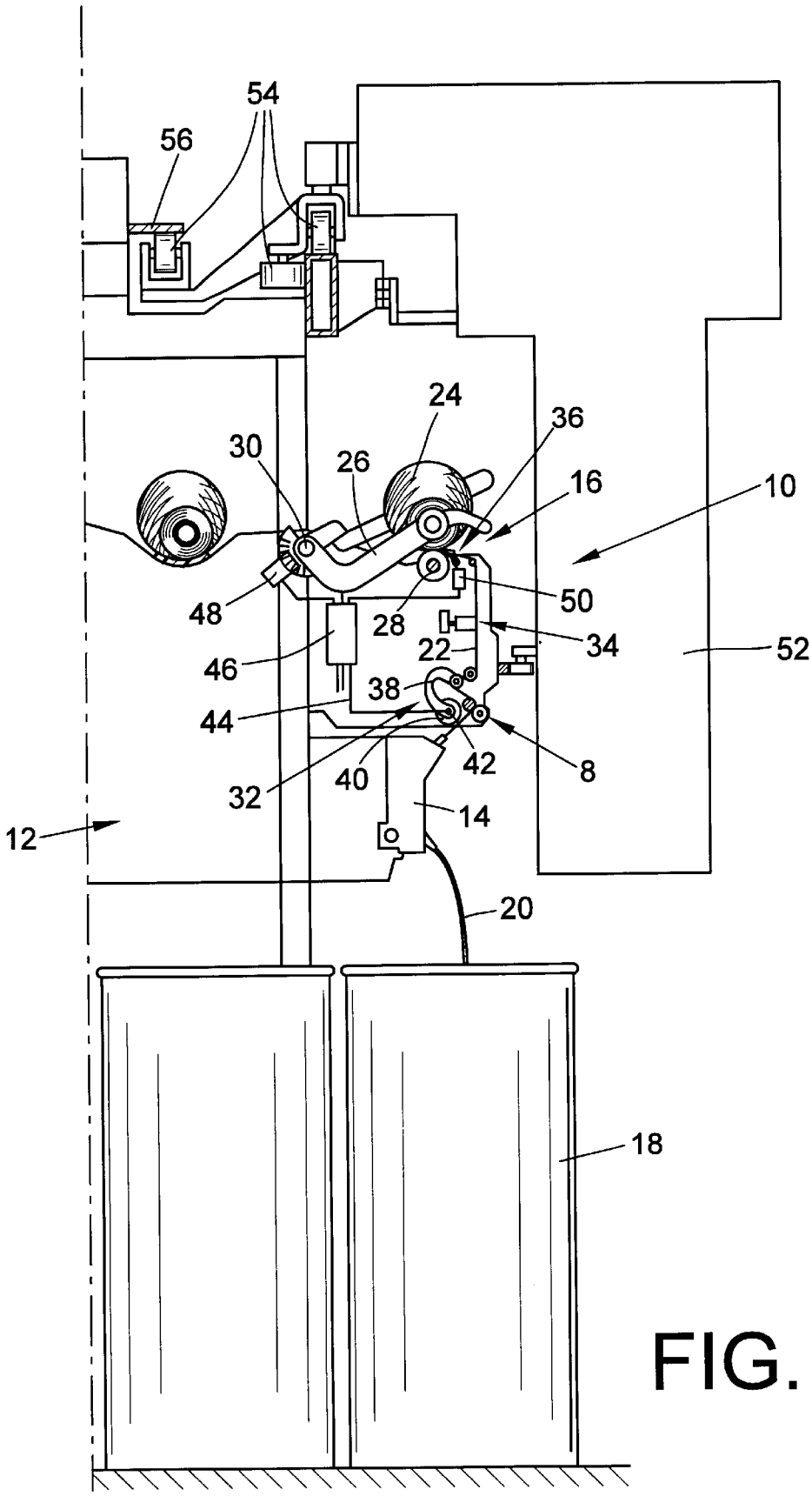
FIG. 1 is a schematic side elevational view of a work station of an open-end rotor spinning machine in accordance with a preferred embodiment of the present invention.

Referring now to the accompanying drawings and initially to FIG. 1, a work station 10 of an open-end rotor spinning machine 12 is shown in side view. Such an open-end rotor spinning machine 12 comprises a plurality of such work stations 10 arranged adjacent to each other along both longitudinal sides of the machine. The design and method of operation of work stations 10 are identical to each other so that only one work station 10 need be shown and described.

Each work station 10 comprises open-end spinning device 14 and winding device 16. As is known, sliver 20 contained in spinning cans 18 is spun into yarn 22 in open-end spinning device 14. Yarn 22 is subsequently wound by winding device 16 into cross-wound bobbin 24. Cross-wound bobbin 24 is held in creel 26 during the spinning/winding process by winding device 16 and is driven via -Friction roller 28 by means of frictional surface contact therebetween. Creel 26 is mounted in a manner such that it can pivot about pivot shaft 30.

Yarn 22 is drawn, at a defined, uniform yarn delivery rate from the spinning device 14 by yarn draw-off device 8, which comprises a driven roller and a pressure roller resting on the driven roller. The driven roller of draw-off device 8, which roller is common to all work stations on a common side of the machine, thus determines the delivery rate of yarn 22 and therewith the winding rate with which yam 22 must be wound onto cross-wound bobbin 24.

Yarn accumulator 32, paraffin-applying device 34 and yarn guide 36 are located downstream from yarn draw-off device 8 in the direction of yarn travel. Yarn guide 36 traverses in a straight line in front of the outer circumference of cross-wound bobbin 24. Given the simultaneous drive of cross-wound bobbin 24 via friction roller 28, yarn 22 is accordingly wound onto cross-wound bobbin 24 in crossing layers.

Figure 2:
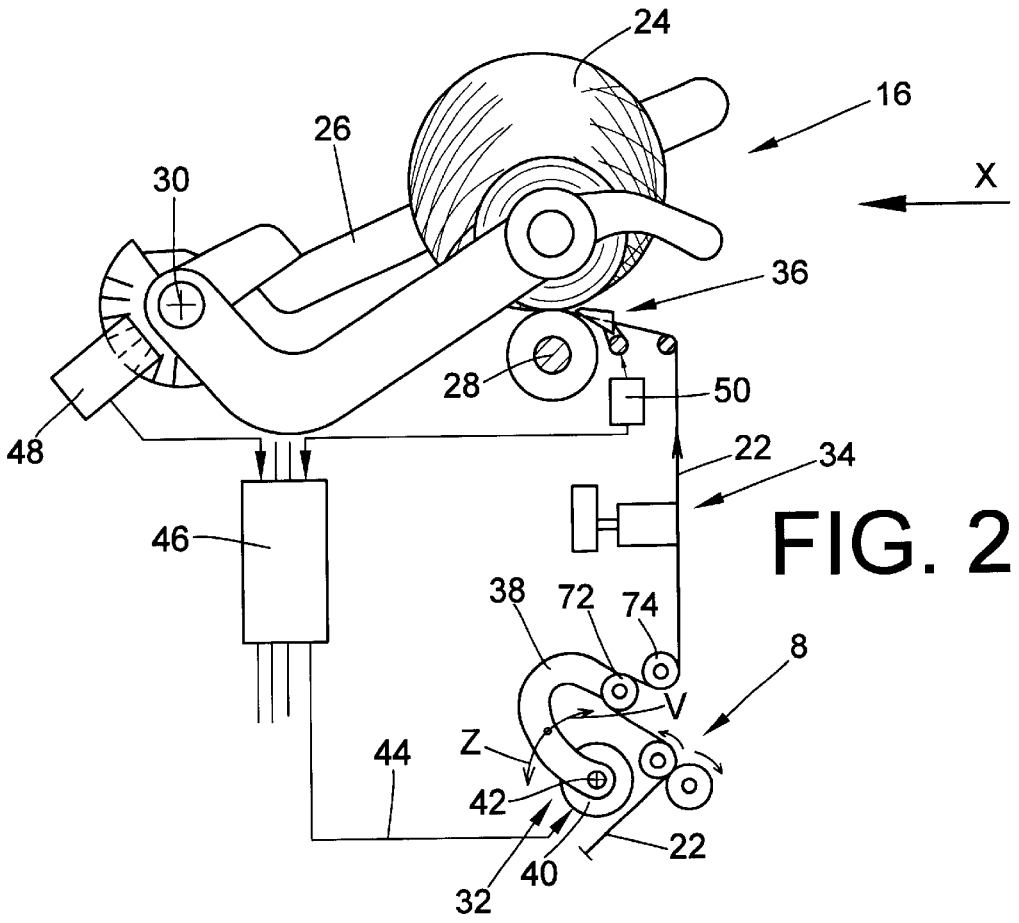
FIG. 2 is a similar schematic side elevational view, on a more enlarged scale, of a winding device equipped with a yarn accumulator in accordance with a first preferred embodiment of the present invention.

As depicted in the exemplary embodiment of FIG. 2, yarn accumulator 32 is arranged between yarn draw-off device 8 and paraffin applying device 34. Yarn accumulator 32 comprises pivot lever 38 which carries guide roller 72 on its end and can be shifted toward and away from the travel path of yarn 22. The pivot angle of this pivot lever 38 can be adjusted in a defined manner by controllable drive 40. Drive 40, preferably a stepping motor, is connected via control lead 44 to control device 46. Control device 46 is also connected to a first sensor device 48 which detects, e.g., the pivot position of creel 26. In addition, control device 46 is connected to a second sensor device 50, 50' which detects the instantaneous position of yarn guide 36.

Open-end rotor spinning machine 12 has an associated automatic service unit 52 which is supported by a roller mechanism 54 on tracks 56 extending along the upper part of open-end spinning machine 12 for traveling movement of service unit 52 along open-end rotor spinning machine 12. Service unit 52 comprises a plurality of manipulating devices (not shown in detail) for starting spinning or for exchanging cross-wound bobbins 24.

The operation of work stations 10 is generally known, and therefore is unnecessary to be discussed in detail within the present specification.

As already explained in the specification above, the yarn winding rate of a cross-wound bobbin results from the speed and the diameter of the driving friction roller as well as from the driven diameter of the cross-wound bobbin. The yarn winding rate of the winding device must be constantly coordinated with the yarn delivery rate of the spinning device. In the case of conical cross-wound bobbins, the driven diameter of the cross-wound bobbin and the diameter of the cross-wound bobbin at the point of yarn application usually do not coincide and therefore the yarn winding rate of the winding device is below the yarn delivery rate at the small diameter of the cross-wound bobbin and above the yarn delivery rate at the large diameter of the cross-wound bobbin. Thus, the difference in yarn length which necessarily occurs must be compensated by a yarn accumulator.

Since yarn 22 is constantly traversed between the large diameter and the small diameter ends of cross-wound bobbin 24 during the winding of a conical cross-wound bobbin 24 while friction roller 28 rotates at a constant speed, a certain yarn length must first be stored at every double stroke of yam guide 36 and subsequently released again. The adaptation of the required amount of yarn to be stored tales place via controllable yam accumulator 32. If the yarn take-up of conical cross-wound bobbin 24 is slight and less than the continuous supply of yam, e.g., when applying the yarn to the smaller diameter end of the bobbin, yarn accumulator 32 is filled by forcing a loop of yarn of an appropriate side by means of pivot lever 38. If the yarn take-up of cross-wound bobbin 24 rises above the continuous yarn supply the required differential amount of yarn is taken out of yarn accumulator 32. The storage content of yarn accumulator 32 can fluctuate thereby, erg., as a function of the conicity of the cross-wound bobbin between a zero value and a maximum value, The control of yarn accumulator 32 is illustrated by a detailed representation of yarn accumulator 32 in FIG. 2, wherein parts which are the same as in FIG. 1 are provided with the same reference numerals and need not be explained again.

It is clear from the foregoing explanation of the general operation of yarn accumulator 32 that the filling and emptying of yarn accumulator, that is, the lengthening and shortening of the stored yarn loops, is a function of the position and of the direction of travel of yarn guide 36 as well as of the diameter of cross-wound bobbin 24. The conditions which develop thereby are explained in detail in the schematic view indicated in FIG. 2*a*, which shows a frontal view of winding device 16 (as viewed in the direction of arrow X in FIG. 2).

Cross-wound bobbin 24 is driven in direction of rotation $R_K$ by friction roller 28 driven in direction of rotation $R_F$. The speed of rotation $R_F$ of friction roller 26 is constant during the entire bobbin travel. Conical cross-wound bobbin 24, which has a large diameter end D and a small diameter end d, is driven in the area of its diameter 60 by frictional annulus 66 arranged on friction roller 28. The yarn winding speed in the area of driven diameter 60 of the cross-wound bobbin corresponds approximately to the yarn delivery speed of spinning device 14. In order to wind yarn 22 onto bobbin 24 in crossing winding layers, yarn 22 is also constantly traversed between small diameter end d and large diameter end D by yarn guide 36 during the winding operation.

During this traversing of yarn 22, the point at which yarn 22 is applied onto cross-wound bobbin 24, and therewith the actual yarn winding speed, constantly change. Thus, a need results for repeatedly filling and emptying yarn accumulator 23 according to the location of the yam application point 70.

In order to appropriately control yarn accumulator 32, the driven diameter $d_a$ of cross-wound bobbin 24 is constantly determined via sensor device 48 which detects, for example, the particular pivot angle of creel 26. At the same time, the instantaneous position and/or the direction of travel of yarn guide 36, and thus the spacing of winding application point 70 of yarn 22 from diameter $d_a$ of cross-wound bobbin 24, are determined via sensor device 50 and 50'. Sensor device 48 can comprise, e.g., a Hall sensor, which operates in a known manner to detect the angular position of creel 26 and supplies a resulting signal proportional to diameter da of cross-wound bobbin 24. Based on the known geometric dimensions of creel 26 and its arrangement relative to friction roller 28 a corresponding diameter signal can be generated in a simple manner.

According to another contemplated embodiment, diameter $d_a$ of cross-wound bobbin 24 can also be calculated mathematically utilizing a sensor device 48' (see FIG. 3) by employing the equation:

$$d_{Ka}=d_F*n_F/n_K,$$

in which $d_F$ is the known diameter of friction roller 28, $n_F$ is the known drive speed of friction roller 28 and $n_K$ is the speed of cross-wound bobbin 24 detected by sensor device 48'.

The instantaneous position of yarn guide 36 and thus yarn application point 70 is located within travel path w (FIG. 2) over which traversing motion 64 of yarn guide 35 takes place. A spacing of the yarn application point 70 to driven diameter $d_a$ of the cross-wound bobbin results in accordance with the actual position of the yarn guide 36. The sensor device for-monitoring yarn guide 36 can be designed in a manner, for example, such that an optical sensor 50 or 50' is installed at one or both reversing points of yarn guide 36.

Sensor devices 48 and 50 supply their signals indicating the particular diameter $d_a$ of cross-wound bobbin 24 and the position and/or the direction of travel of yarn guide 36 to control device 46, where the signals are processed in a manner such that the instantaneous yarn application point of the yarn (and therewith the instantaneous yarn winding rate), the direction of travel of yarn guide 36 and the instantaneous driven diameter of the cross-wound bobbin are determined. Drive 40 of yarn accumulator 32 is initiated from control device 46 via control line 44 in accordance with this evaluation. Drive 40 is preferably designed as a stepping motor hose drive shaft is coupled to pivot shaft 42 of pivot lever 38. The coupling can take place either directly or via an intermediary transmission. A defined change of position of pivot lever 38 is possible either in direction Z or in direction V by means of stepping motor 40.

As FIG. 2 shows, pivot lever 38 comprises guide roller 32 on its end facing away from pivot shaft 42 about which roller the yarn 22 travels. Before yarn 22 travels over guide roller 72, the yarn is guided through draw-off device 8. Stationary deflection roller 74 is located downstream from guide roller 72 in the travel path of the yarn. By this arrangement, a shift in the position of pivot lever 38 influences the travel path of the yarn between draw-off device 8 and deflection roller 74. When pivot lever 38 moves in direction Z, the travel path of the yarn is lengthened and yarn accumulator 32 is therefore filled and, when pivot lever 38 moves in direction V, the travel path of the yarn is shortened again and yarn accumulator 32 is therefore emptied.

It is thus clear from the above explanation that the travel path of yarn 22 between draw-off device 8 and deflection roller 74 is determined by the position of pivot lever 38 and thus by the control of drive 40. Since drive 40 receives its control signals as a function of the actual prevailing instantaneous diameter $d_a$ of cross-wound bobbin 24 as well as of yarn application point 70 on cross-wound bobbin 24, an exact determination of the yarn length to be stored in yarn accumulator 32 is possible.

Figure 2A:
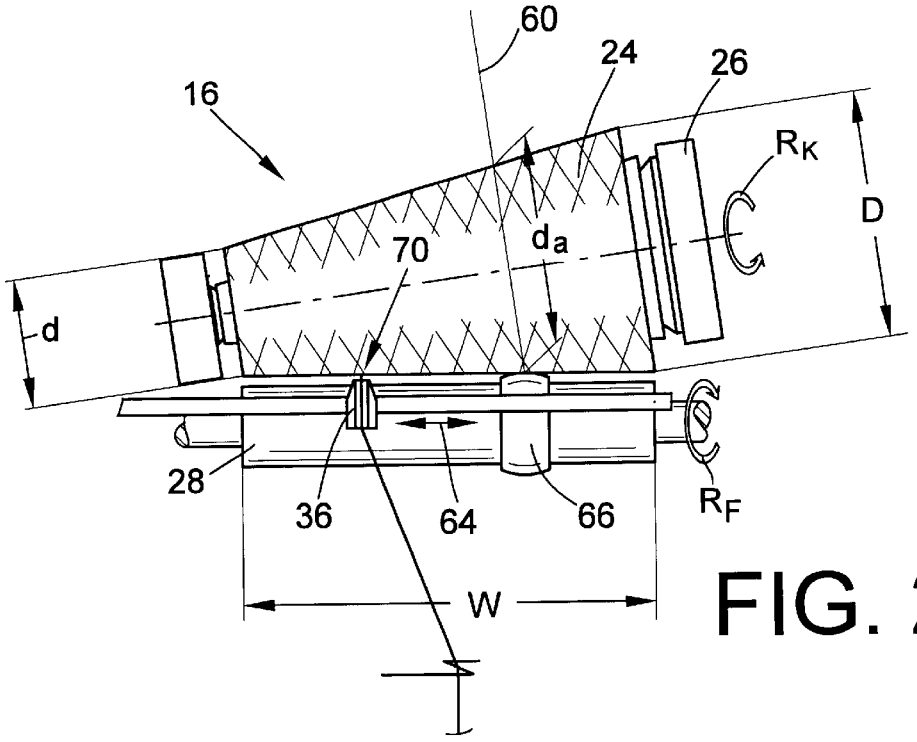
FIG. 2*a* is a front elevational view of the winding device of FIG. 2 as viewed along arrow X of FIG. 2.
Figure 3:
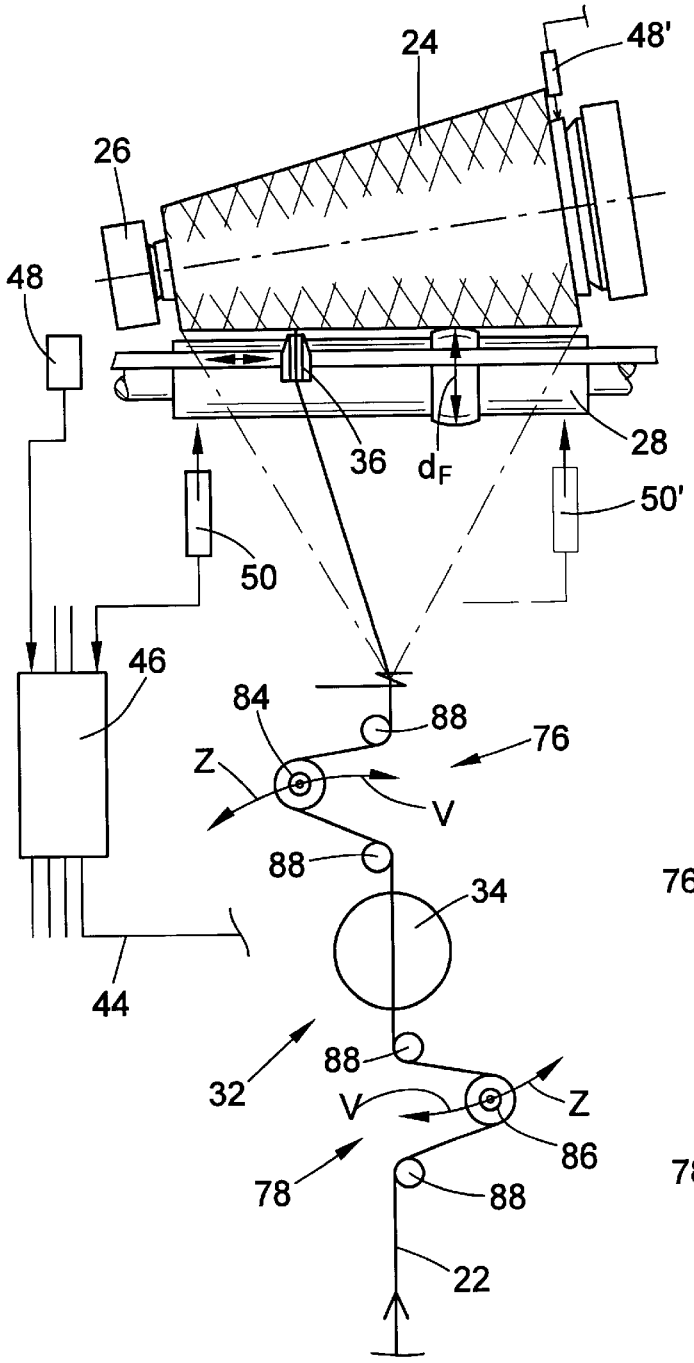
FIG. 3 is another schematic front elevational view, similar to FIG. 2*a*, of a winding device equipped with a yarn accumulator in accordance with a second preferred embodiment of the present invention.
Figure 4:
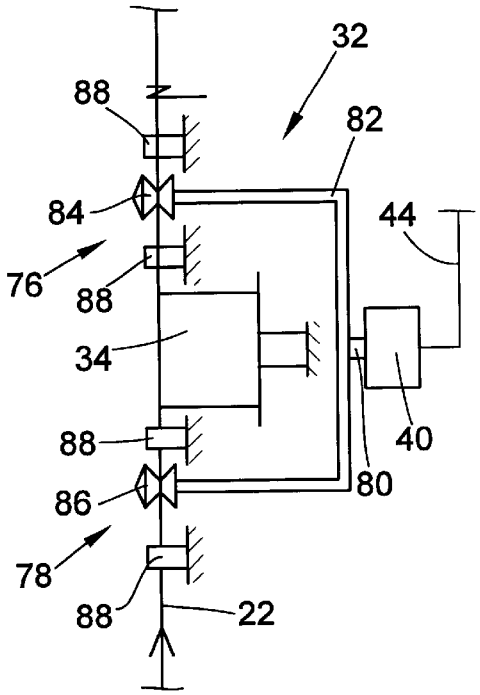
FIG. 4 is a schematic view of the yarn accumulator of FIG. 3 rotated through 90 degrees.

FIGS. 3 and 4 show another embodiment of a yarn accumulator 32, which otherwise conforms to the design, method of operation and the control of yarn accumulator 32 as described above with respect to FIGS. 1, 2 and 2*a*. The essential difference of yarn accumulator 32 according to FIGS. 3 and 4 over yam accumulator 32 according to FIGS. 1, 2 and 2*a* is that, in this instance, two partial accumulators 76 and 78 are formed in which the travel path of yam 22 is lengthened or shortened. To this end, driven shaft 80 of drive 40 carries bracket 82 on the ends of which guide rollers 84 and 86 are arranged. Guide rollers 84 and 86 have a guide groove in which yarn 22 is guided. Guide rollers 84 and 86 are pivotably mounted between stationarily arranged guide rollers 88.

The control of drive 40 also takes place here via control device 46, which evaluates the signals supplied by sensor devices 48, 48' and 50, 50'. Bracket 82 can be pivoted by drive 40 so that guide rollers 84 and 86 enter oppositely into the yarn guide path between the two stationary guide rollers 88. This results in essentially a double stroke by means of the rotary movement of guide rollers 84 and 86 and, in turn, resulting in a lengthening of the yarn travel path which is twice as long as results from the pivot movement of pivot lever 38 in FIG. 2. In particular, this makes it possible to reduce the installation space for yarn accumulator 32 since the pivot path of bracket 82 to be kept free is minimized by its ability to execute double strokes. The yarn accumulator 32 according to the exemplary embodiment in FIGS. 3, 4 is preferably located in the inmmediate area of paraffin applying device 34.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A device for winding a conical cross-wound bobbins comprising a creel for receiving a conical bobbin and mounted for pivotal movement about a pivot axis, a yarn guide traversing along the creel for applying a yarn in cross-wound layers on the bobbin, a yarn accumulator movable relative to a travel path of the yarn for lengthening and shortening the yarn path, a first sensor device for determining and electronically signaling an instantaneous driven diameter of the bobbin, a second sensor device for detecting and electronically signaling an instantaneous point at which yarn is applied to the bobbin by sensing a position of the yarn guide, and a control device electronically connected to the first and second sensor devices for controlling the yarn accumulator in a defined manner as a function of the signal of the first and second sensor device, said function avoiding undesired changes in yarn tension in the yarn accumulator.

2. The device according to claim 1, characterized in that the first sensor device for determining the diameter of the bobbin detects a pivot position of the creel.

3. The device according to claim 1, characterized in that the first sensor device for determining the diameter of the bobbin detects a speed of the bobbin.

4. The device according to claim 1, characterized in that the first sensor device comprises a Hall sensor.

5. The device according to claim 1, characterized in that the first sensor device is connected to the control device and the control device calculates the diameter of the bobbin from a known diameter and a known drive speed of a drive roller in frictional surface contact with the bobbin and a speed of the bobbin detected by the first sensor device.

6. The device according to claim 1, characterized in that the second sensor device is disposed adjacent to a reversing location in the traversing movement of the yarn guide.

7. The device according to claim 1, characterized in that the yarn accumulator comprises a pivot lever and a drive for moving the pivot lever relative to the yarn travel path and the control device is connected to the drive of the yarn accumulator for moving the pivot lever of the yarn accumulator in accordance with the instantaneous point of yarn application onto the bobbin.

8. The device according to claim 7, characterized in that the drive is a stepping motor.

9. The device according to claim 8, characterized in that the stepping motor has a drive shaft connected to a pivot shaft of the pivot lever of the yarn accumulator.

10. The device according to claim 7, characterized in that the drive is arranged for moving the pivot lever in a first direction relative to the yarn travel path and in an opposite direction relative to the yarn travel path.

11. The device according to claim 1, characterized in that the yarn accumulator comprises a bracket having two arms pivotable in coordination with one another between two stationary yarn deflection rollers and a yarn guide roller arranged on each arm.

12. The device according to claim 1, characterized in that the yarn accumulator is arranged in the area of a paraffin applying device.

* * * * *